US007723408B2

(12) United States Patent
Gerhardt et al.

(10) Patent No.: US 7,723,408 B2
(45) Date of Patent: May 25, 2010

(54) COMPOSITE MATERIALS HAVING LOW FILLER PERCOLATION THRESHOLDS AND METHODS OF CONTROLLING FILLER INTERCONNECTIVITY

(75) Inventors: Rosario A. Gerhardt, Marietta, GA (US); Runqing Qu, Roswell, GA (US); Zhi Li, Atlanta, GA (US); Robert J. Samuels, Atlanta, GA (US); Charles J. Capozzi, Alexandria, VA (US)

(73) Assignee: Georgia Tech Research Corporation, Atlanta, GA (US)

( * ) Notice: Subject to any disclaimer, the term of this patent is extended or adjusted under 35 U.S.C. 154(b) by 897 days.

(21) Appl. No.: 11/357,582

(22) Filed: Feb. 16, 2006

(65) Prior Publication Data

US 2006/0186384 A1 Aug. 24, 2006

Related U.S. Application Data

(60) Provisional application No. 60/653,593, filed on Feb. 16, 2005, provisional application No. 60/735,043, filed on Nov. 9, 2005.

(51) Int. Cl.
*B22F 1/00* (2006.01)

(52) U.S. Cl. ..... 524/1; 524/403; 524/413; 524/430; 524/439; 524/495; 523/204; 252/62.54; 252/511; 252/512; 252/514; 501/134; 501/137; 501/139

(58) Field of Classification Search ..... None
See application file for complete search history.

(56) References Cited

U.S. PATENT DOCUMENTS 2,761,854 A * 9/1956 Coler ..... 523/204

(Continued)

OTHER PUBLICATIONS

Soares et al. (Journal of Applied Polymer Science, 69 (1998) 825-833).*

(Continued)

*Primary Examiner*—David Wu
*Assistant Examiner*—Vu Nguyen
(74) *Attorney, Agent, or Firm*—Thomas, Kayden, Horstemeyer & Risley, LLP; Todd Deveau

(57) ABSTRACT

Composite materials are disclosed having low filler percolation thresholds for filler materials into the composite matrix material along with methods of controlling filler interconnectivity within the composite matrix material. Methods are, thus, disclosed that provide the ability to control the desired properties of the composites. The composites of the present disclosure are characterized by a "pseudo-crystalline" microstructure formed of matrix particles and filler particles where the matrix particles are faceted and substantially retain their individual particle boundaries and where the filler particles are interspersed between the matrix particles at the individual matrix particle boundaries such that the filler particles form a substantially interconnected network that substantially surrounds the individual faceted matrix particles. In an exemplary embodiment, the composites are formed by selecting matrix particles and filler particles wherein the ratio of the average size of the matrix particles to the average size of the filler particles is about 10 or more. The selected matrix particles exhibit a glass transition temperature. The matrix particles and the filler particles are mechanically mixed and then subjected to a temperature above the glass transition temperature of the matrix particles and a compression pressure for a period of time sufficient to cause the matrix particles to undergo deformation so as to compress them together eliminating void spaces between the particles without melting the matrix material. The method is also demonstrated to work in combination with more standard art methods such as solution mixing for the purposes of achieving additional control of the properties.

28 Claims, 11 Drawing Sheets

U.S. PATENT DOCUMENTS

| | | | | |
|---|---|---|---|---|
| 4,735,796 | A * | 4/1988 | Gordon | 424/9.32 |
| 4,826,997 | A | 5/1989 | Kirchhoff | |
| 6,197,898 | B1 | 3/2001 | van den Berg et al. | |
| 6,331,265 | B1 | 12/2001 | Dupire et al. | |
| 6,331,586 | B1 | 12/2001 | Thielen et al. | |
| 6,599,446 | B1 | 7/2003 | Todt et al. | |
| 2003/0031438 | A1 | 2/2003 | Kambe et al. | |
| 2003/0100829 | A1 * | 5/2003 | Zhong et al. | 600/424 |
| 2003/0216496 | A1 | 11/2003 | Mohanty et al. | |
| 2004/0063566 | A1 * | 4/2004 | Caspers et al. | 501/134 |
| 2004/0262584 | A1 | 12/2004 | Bonnet et al. | |
| 2005/0022698 | A1 | 2/2005 | Mazany et al. | |

OTHER PUBLICATIONS

Fu et al. (Macromolecules 37 (2004) 6918-6925).*

Sato et al. (Jpn. J. Appl. Phys. 37 (1998) Pt. 2, No. 2A, L129-L131).*

International Search Report issued Feb. 16, 2006 based on corresponding application PCT/US2006/05734.

Jog, J. P. "Solid State Processing of Polymers: A Review." Adv. Polym. Tech. 12, 3 (1993): 281-289.

Greco, A. and Maffezzoli, A. "Polymer Melting and Polymer Powder Sintering by Thermal Analysis." J. Therm. Anal. Calorimetry. 72 (2003): 1167-1174.

Malliaris, A. and Turner, D. T. "Influence of Particle Size on the Electrical Resistivity of Compacted Mixtures of Polymeric and Metallic Powders." J. Appl. Phys. 42, 2 (1971): 614-618.

Kusy, R. P. and Turner, D. T. "Electrical Conductivity of a Polyurethane Elastomer Containing Segregated Particles of Nickel." J. Appl. Polym. Sci. 17, 5 (1973): 1631-1633.

Kusy, R. P. and Turner, D. T. "Electrical Resistivity of a Polymeric Insulator containing Segregated Metallic Particles." Nat. Phys. Sci. 229, 2 (1971): 58-59.

Mukhopadhyay, R., De, S. K and Basu, S. "Effect of Metal Concentration on the Electrical Conductivity and Some Mechanical Properties of Poly(methyl Methacrylate)-Copper Composites." J. Appl. Polym. Sci. 20, 9 (1976): 2575-2580.

Bhattacharya, S. K., Basu, S. and De, S. K. "Studies on Poly(Vinyl Chloride)-Copper Composites. Part 1: State of Segregation of Filler Particles, Electrical and Mechanical Properties in the Presence of Plasticizer and Stabilizer." Poly. Eng. Sci. 19, 8 (1979): 533-539.

Pinto, G and Maaroufi, A. K. "Conducting Polymer Composites of Zinc-Filled Urea-Formaldehyde." J. Appl. Poly. Sci. 96 (2005): 2011-2015.

Chan, C. M., Cheng, C. L. and Yuen, M. M. F. "Electrical Properties of Polymer Composites Prepared by Sintering a Mixture of Carbon Black and Ultra-High Molecular Weight Polyethylene Powder." Polym. Eng. Sci. 37, 7 (1997): 1127-1136.

Bouchet, J., Carrot, C., Guillet, J., Boiteux, G., Seytre, G. and Pineri, M. "Conductive Composites of UHMWPE and Ceramics Based on the Segregated Network Concept." Polym. Eng. Sci. 40, 1 (2000): 36-45.

* cited by examiner (A)

(B)

(A)

(B)

(A) (B)

(A) (B)

COMPOSITE MATERIALS HAVING LOW FILLER PERCOLATION THRESHOLDS AND METHODS OF CONTROLLING FILLER INTERCONNECTIVITY

CROSS-REFERENCE TO RELATED APPLICATIONS

This application claims priority to U.S. provisional patent application Ser. Nos. 60/653,593, filed on Feb. 16, 2005; and 60/735,043, filed on Nov. 9, 2005, each of which is entirely incorporated herein by reference.

STATEMENT REGARDING FEDERALLY SPONSORED RESEARCH OR DEVELOPMENT

Aspects of the work described herein were supported by Grant No. DMR-0076153 from the National Science Foundation. Therefore, the U.S. government has certain rights in the invention(s).

FIELD OF THE DISCLOSURE

The present disclosure is generally related to composite materials and methods of making composite materials having a low filler percolation threshold and to methods of controlling the interconnectivity of filler particles in composite materials and controlling the properties of the composite materials.

BACKGROUND

A wide variety of pure phase materials such as polymers are now readily available at low cost. However, low cost pure phase materials are somewhat limited in the achievable ranges of a number of properties, including, for example, electrical conductivity, magnetic permeability, dielectric constant, piezoelectric coefficients, refractive index, luminescence and others. In order to overcome these limitations, composites can be formed, in which a matrix is blended with a filler material with desirable properties. Examples of these types of composites include the carbon black and ferrite mixed polymers that are used in toners, tires, electrical devices, and magnetic tapes.

The number of suitable filler materials for composites is growing, but the process is still limited. In particular, difficulties in fabrication of such composites often arise due to issues of interface stability between the filler and the matrix, and because of the difficulty of orienting and homogenizing filler material in the matrix. Some desirable properties of the matrix material (e.g., rheology) may also be lost when certain fillers are added, particularly at the high loadings required to achieve percolation using conventional fabrication techniques. In making such composites, a sufficient amount of filler must be added to overcome the percolation threshold, the critical concentration of filler at which the polymer will begin to acquire the property of the filler (e.g., in the case of electrically conducting fillers, the percolation threshold is the concentration of filler at which the composite will conduct an electrical current). Beyond this threshold, the property generally increases markedly as additional filler is added. It is believed that at the percolation threshold, uninterrupted chains of filler particles first appear in the system. The addition of still greater amounts of filler produces a correspondingly higher number of uninterrupted chains, which results in still higher levels of the desired property until the property levels out to that of the properties of the filler.

For instance, electrically insulating polymers can be made electrically conductive via the addition of electrically conductive fillers, such as carbon fibers, carbon blacks, carbon nanotubes or metal fibers. Electrically conductive polymer systems are prized as materials for electromagnetic shielding in electronics applications and as materials used in the fabrication of structures to which paint may be applied using electrostatic painting techniques. Certain fillers such as carbon fibrils are high cost materials. Often the filler material is more expensive than the matrix material, particularly at known achievable percolation thresholds. Additionally, the use of such fillers may degrade other important physical characteristics of the material such as its impact strength. Some electrically conductive fillers have a more pronounced negative effect on certain material's physical properties than others, but nearly all polymer systems incorporating them suffer a degradation of impact strength, or certain other physical properties not related to conductivity, relative to the unfilled polymer systems. In many instances, the desired level of electrical conductivity cannot be obtained without sacrificing at least some part of the material's inherent impact strength or other properties.

Therefore, it would be desirable to maximize the electrical conductivity enhancing effect of the conductive filler while minimizing the filler cost to achieve the desired electrical conductivity by reducing the percolation threshold for the filler. Further, it would be desirable to maximize the electrical conductivity enhancing effect of the conductive filler while minimizing the resultant change or loss in other matrix properties. The ability to fabricate composites having the desirable properties of a filler material, by using a lower amount of filler material and the ability to control the amount of the property acquired by the composite material would significantly expand the scope of manufacturable composites.

SUMMARY

The composite materials of the present disclosure having filler interconnectivity and the methods of making the same and controlling filler interconnectivity are directed to the aforementioned needs. Embodiments of the present disclosure include methods of making composite materials that result in controlled microstructures with various degrees of interconnectivity of filler material. Some advantages of the present methods of making composites include, but are not limited to, the ability to fabricate specimens using relatively inexpensive commercially available equipment and the ability to achieve a desired property (e.g., conductivity, absorption, luminescence, magnetic induction, etc.) in the composite material using relatively little filler material (usually the most expensive component) in comparison to conventional techniques. The methods of the present disclosure provide for the fabrication of many different composites with dimensions ranging from the nanometer to millimeter size features depending on the size and properties of precursor materials that are used. Another advantage of the methods of the present disclosure is the ability to control the desired properties of the composite materials formed by the methods of the present disclosure by a combination of preparation methods, as discussed below.

According to the methods of the present disclosure, the formation of the interconnected network of filler material can be controlled by manipulating one or more of various factors including, but not limited to, the initial particle size distribution of each of the constituent phases (e.g., the ratio of the average particle size of the matrix material to the average particle size of the filler material), the amount of filler used (e.g., the concentration of filler material), the mixing conditions (e.g., mechanical mixing, solution mixing, a combination thereof, or other mixing technique), and the molding conditions (e.g., time, temperature, and pressure). In some embodiments of the present disclosure, when an appropriate combination of the above conditions is achieved, very little amount of the filler is needed to achieve percolation. In other embodiments, the above conditions (e.g., the processing procedures, such as mixing and molding conditions) can be modified to prevent percolation at a similar volume fraction of filler material.

The methods and compositions of the present disclosure have a wide range of applicability for any material application where it is desirable to control the properties of a composite material by the addition of a filler material. This includes composites that may be used for applications such as, but not limited to, electromagnetic interference shielding, radar antennas, gas and moisture sensors, photonic and electromagnetic crystals with controlled band gaps, electrolytes and electrodes for fuel cells and batteries, electroluminescent displays, magnetic strips, biomedical sensors, and others. The methods of the present disclosure also have the potential to be used not only for polymeric matrices but also glassy matrices, and other appropriate matrix materials.

The composites of the present disclosure are characterized by a "pseudo-crystalline" microstructure formed of matrix particles and filler particles where the matrix particles are faceted and substantially retain their individual particle boundaries and where the filler particles are interspersed between the matrix particles at the individual matrix particle boundaries such that the filler particles form a substantially interconnected network that substantially surrounds the individual faceted matrix particles.

In an exemplary embodiment, the composites are formed by selecting matrix particles and filler particles wherein the ratio of the average size of the matrix particles to the average size of the filler particles ranges from about 10 to about 10,000. The selected matrix particles exhibit a glass transition temperature. The matrix particles and the filler particles are mechanically mixed and subjected to a temperature above the glass transition temperature of the matrix particles and a compression pressure and for a period of time sufficient to cause the matrix particles to undergo deformation so as to compress them together eliminating void spaces between the particles without melting the matrix material. As a non-limiting example, the mixture of matrix and filler particles can be heated to a temperature about 40° C. to about 100° C. above the glass transition temperature of the matrix particles, but below their melting temperature, at a pressure of about 2 kN to about 24 kN for about 2 to about 25 minutes. In a further embodiment, the mixture of matrix and filler particles can be pre-heated to a first temperature and then pressed at another temperature. In a further embodiment, the matrix material can be a polymer material, for example a thermoplastic polymer material. The filler material can be an electrically conductive powder, a conductive ceramic material, a dielectric material, a luminescent material, a magnetic material, or other material having a selected property for inclusion within the matrix material and desired in the final composite.

In yet a further embodiment, the above method of mechanically mixing the matrix and filler particles can be combined with the known solution method of mixing matrix and filler particles to adjust or control the final composite properties.

Other aspects, compositions, systems, devices, methods, features and advantages of the present disclosure will be or become apparent to one with skill in the art upon examination of the following drawings and detailed description. It is intended that all such additional compositions, systems, methods, features, and advantages be included within this description, be within the scope of the present invention, and be protected by the accompanying claims.

BRIEF DESCRIPTION OF THE DRAWINGS

The disclosure can be better understood with reference to the following drawings. The components in the drawings are not necessarily to scale, emphasis instead being placed upon clearly illustrating the principles of the present disclosure.

FIG. 1A illustrates the "pseudo-crystalline" microstructure of the present disclosure, where the initial particle boundaries of the polymer matrix particles are preserved, and FIG. 1B illustrates a prior art composite, where the polymer matrix material is intimately mixed with the filler, and the particle boundaries of the polymer matrix particles are not preserved.

DETAILED DESCRIPTION

Before the embodiments of the present disclosure are described in detail, it is to be understood that unless otherwise indicated the present disclosure is not limited to particular materials, reagents, reaction materials, manufacturing processes, or the like, as such may vary. It is also to be understood that the terminology used herein is for purposes of describing particular embodiments only, and is not intended to be limiting. It is also possible in the present disclosure that steps may be executed in different sequence where this is logically possible.

It must be noted that, as used in the specification and the appended claims, the singular forms "a," "an" and "the" include plural referents unless the context clearly dictates otherwise. Thus, for example, reference to "a support" includes a plurality of supports.

Exemplary composites according to the present disclosure have been fabricated using various thermoplastic polymers (e.g., PMMA, ABS, PS, PEO, and the like as the matrix material and a variety of fillers. Exemplary fillers include various conducting materials (e.g., carbon black (CB), indium tin oxide (ITO), Ag, Cu, $LiClO_4$, and the like, or combinations thereof), various luminescent materials (e.g., various red, green, and blue phosphors, and the like, and combinations thereof), various dielectric materials (e.g., $CeO_2$, $BaTiO_3$,, $Al_2O_3$, $(Pb,Zr)TiO_3$ (PZT) and the like, and combinations thereof), and various magnetic materials (e.g., $Dy_2O_3$, $Gd_2O_3$, and the like, and combinations thereof). Various conductive ceramic particles are also suitable fillers. Exemplary conductive ceramic particles include $RuO_2$, SiC, YBCO, BSCCO, and borides.

Figure 1:
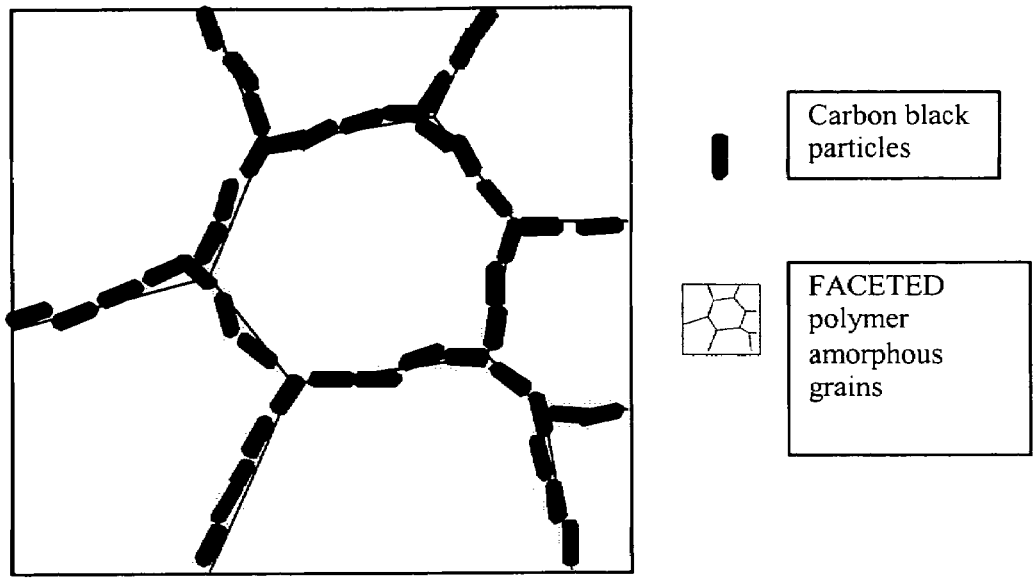
FIG. 1 is a schematic of the microstructure of an exemplary polymer matrix composite of the present disclosure compared to a polymer matrix composite made according to prior art methods.
Figure 1:
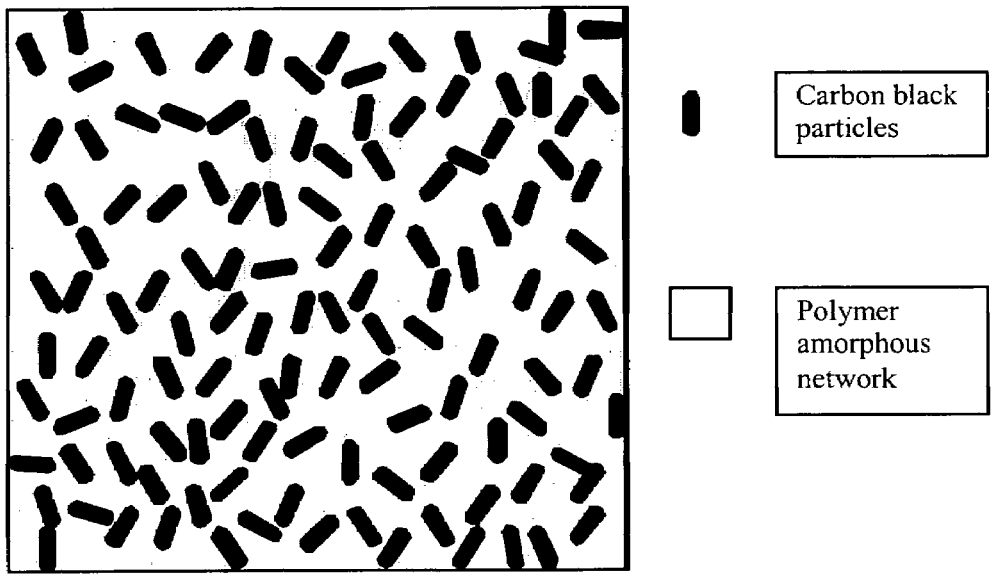
Figure 2:
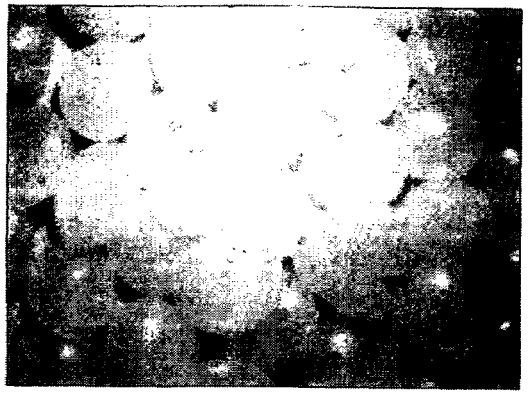
FIG. 2A displays some polymer particles prior to mixing with a filler material.
FIG. 2B displays the resultant composite made according to an exemplary embodiment of the present disclosure, showing the interconnected network of the filler surrounding the polymer particles.
Figure 2:
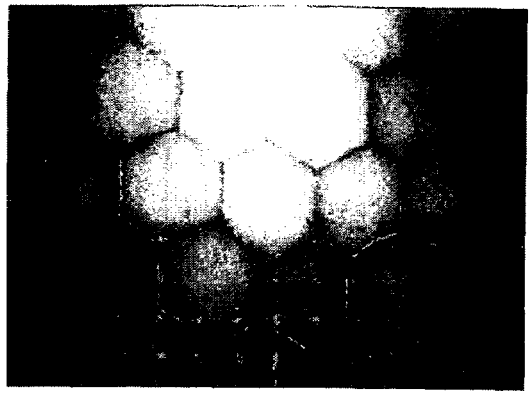
Figure 3:
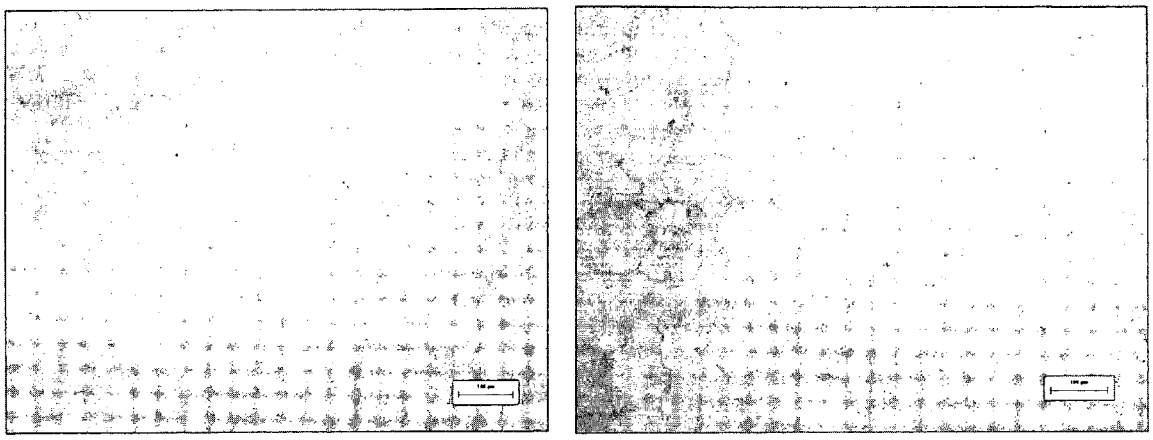
FIGS. 3A and B present top and bottom transmission optical micrographs, respectively, of a transparent composite according to an exemplary embodiment of the present disclosure to demonstrate that the "pseudo-crystalline" microstructure is present in three dimensions.

The composite materials of the present disclosure have a unique, controllable, microstructure that results in a percolation threshold that is generally lower than composites made by conventional methods. In the case of a composite comprised of an insulating matrix material and conductive fillers, the "percolation threshold" is the concentration (i.e., volume percent of filler in the composite) when the first continuous network of conducting fillers is established across the composite. As shown schematically in FIG. 1A, and also in the SEM image of FIG. 4, the composites of the present disclosure have a "pseudo-crystalline" microstructure where the polymer matrix particles substantially retain their individual particle boundaries and where the filler particles form a substantially interconnected network that substantially surrounds the individual faceted polymer particles. In contrast, FIG. 1B displays a schematic of the microstructure of a composite formed from a conventional solution method. In the prior art composite, the filler particles are mixed homogeneously throughout the matrix material, which has formed a continuous phase and does not retain particle boundaries. It can be seen that a greater amount of filler particles would be required to achieve percolation in the composite illustrated in FIG. 1B. FIG. 2 is a photograph showing the microstructure formed in an embodiment of the composite of the present disclosure. FIG. 2A is a picture of the starting polymer pellets, and FIG. 2B illustrates the filler particles making an interconnected network surrounding the polymer particles in the resultant composite. The resultant composite of FIG. 2B is an embodiment in which the matrix and filler particles were mechanically mixed and then compression molded as described in the manner of the Examples below. FIG. 3 shows the top and bottom transmission optical images of a transparent composite which shows that the fillers in the resultant composite are interconnected in three dimensions.

Figure 4:
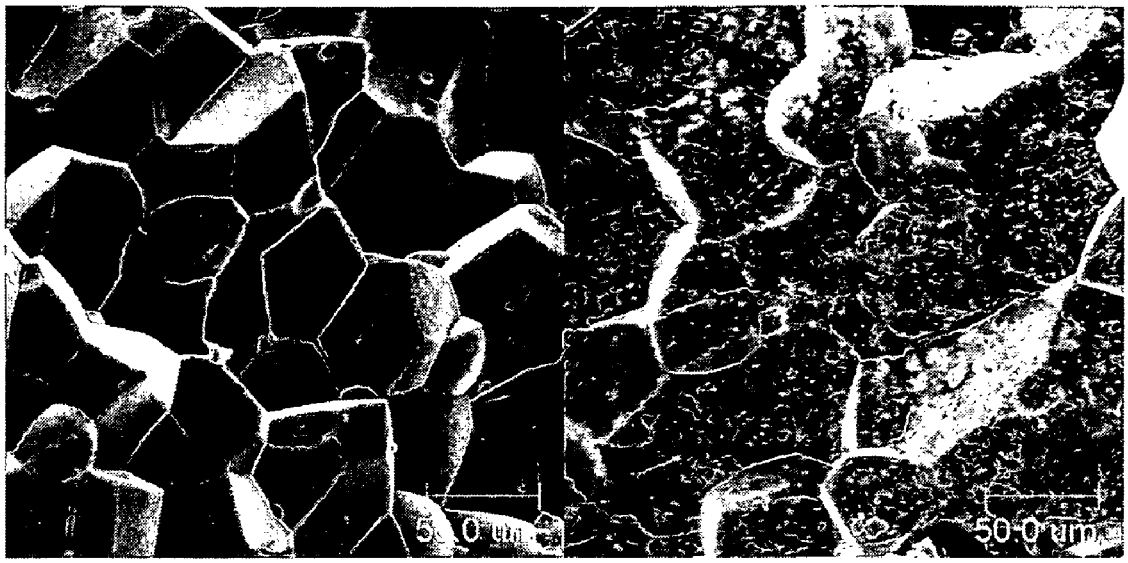
FIG. 4 is an SEM image of the fractured surfaces of two different polymer matrix composites of the present disclosure, depicting the coated surfaces and illustrating the filler coated faceted polymer microstructure. The image on the left contains finer and unagglomerated fillers. In the right hand image, some agglomeration of filler can be seen.
Figure 11:
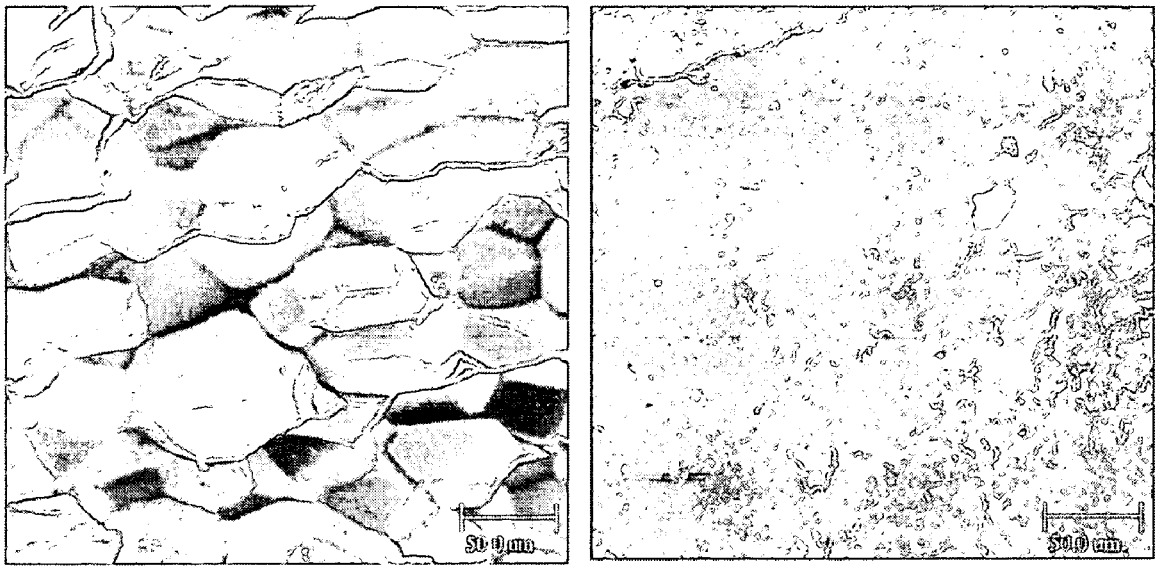
FIGS. 11A and B are SEM images of PMMA/CB composite specimens with 5 phr CB made by (A) mechanical mixing method, and (B) solution mixing method.

The unique microstructure of the composites of the present disclosure is further demonstrated in the SEM images in FIG. 4 of fractured surfaces of two exemplary composites containing two different fillers, and in FIG. 11A. The fractured surfaces corroborate the presence of the polymer-polyhedra that are shown in various embodiments of the disclosure. The smoothness of the fractured surface is believed to be a function of the initial filler particle size and polymer-filler compatibility.

Materials

The composite materials of the present disclosure include at least a matrix material and a filler material having a desired property. The matrix material can be a polymeric material having a glass transition temperature. The matrix material can also be a ceramimetallic, glassy material, or a combination thereof. The matrix material may be chosen for properties such as ease of processibility, low cost, environmental benignity, commercial availability, and compatibility with the desired filler.

Exemplary matrix materials include, but are not limited to, commonly known thermoplastic materials that are either commercially available or prepared according to known synthetic methodology such as those methods found in Organic Polymer Chemistry, by K. J. Saunders, 1973, Chapman and Hall Ltd. Examples of classes of thermoplastic polymeric materials suitable for use as the matrix material, either singly or in combination with another material include, but are not limited to, polyphenylene ethers, polyamides, polysiloxanes, polyesters, polyimides, polyetherimides, polysulfides, polysulfones, polyethersulfones, olefin polymers, polyurethanes and polycarbonates. The matrix material may also include thermosetting materials such as, but not limited to, polyepoxides, phenolic resins, polybismaleimides, natural rubber, synthetic rubber, silicone gums, thermosetting polyurethanes, and the like.

In some preferred embodiments, the matrix material is selected from thermoplastic polymers including, but not limited to, poly(methyl methacrylate) (PMMA), poly(acrylonitrile-co-butadiene-co-styrene) (ABS), polystyrene (PS), and polyethylene oxide (PEO), and combinations thereof.

The filler material may be selected based on the property that is desired in the resulting composite material. For example, filler materials may be chosen that have properties selected from, but not limited to, electrical conductivity, thermal conductivity, luminescence, electrical insulation, magnetic induction, optical transmission, and optical absorption.

For embodiments where the desired property is electrical conductivity, exemplary suitable electrically conductive fillers include, but are not limited to, carbon black, carbon fibers, carbon fibrils, carbon nanotubes, metal coated carbon fibers, metal coated graphite, metal coated glass fibers, conductive polymer filaments, metallic particles, stainless steel fibers, metallic flakes, metallic powders, conducting ceramic particles, platelets, fibers and whiskers, conducting polymers and the like. Some commonly known electrically conductive fillers, such as carbon black and carbon fibrils, are either commercially available or may be prepared according to known synthetic methodology such as those methods found in U.S. Pat. Nos. 5,591,382 and 4,663,230, which are hereby incorporated by reference.

Some other possible filler materials include, but are not limited to, metals (e.g., Cu, Ag, Ni, Fe, Al, Pd, and Ti), oxide ceramics (e.g., $TiO_2$, $TiO_{2-x}$, $BaFe_2O_4$, ZnO, $RuO_2$, YBCO, BSCO, $BaTiO_3$, PZT, and other dielectric, conducting and piezoelectric compositions as well as ferrites, and manganites), carbide ceramics (e.g., SiC, BC, TiC, WC, $WC_{1-x}$), nitride ceramics (e.g., $Si_3N_4$, TiN, VN, AlN, and $Mo_2N$), hydroxides (e.g., aluminum hydroxide, calcium hydroxide, and barium hydroxide), borides (e.g., $AlB_2$ and $TiB_2$), phosphides (e.g., NiP and VP), sulfides (e.g., molybdenum sulfide, titanium sulfide, and tungsten sulfide), silicides (e.g., $MoSi_2$), chalcogenides (e.g., $Bi_2Te_3$, $Bi_2Se_3$), as well as other polymers and combinations thereof.

Methods of Making Composites of the Present Disclosure

The composites of the present disclosure are made by providing one or more matrix materials as described above, and one or more filler materials as described above, and then mixing the matrix material with the desired filler to form a matrix-filler mixture. The mixture is then compression molded at a temperature and a pressure and for an amount of time sufficient to achieve a desired amount of connectivity of filler material to achieve the desired amount of the desired property in the composite material. In some embodiments the method includes pre-heating the matrix-filler mixture at a first pressure and a first temperature, and then heating at a second pressure and second temperature. In some embodiments the second pressure and/or temperature are higher than the first temperature and pressure. The resulting composite is then cooled.

In some embodiments, the matrix and filler particles may be mechanically mixed using a mortar and pestle, a blender, or some other mixing equipment, or by a manual mechanical mixing method (such as shaking or stirring), to form a matrix-filler mixture (referred to as "mechanically dry mixing"). In other embodiments a combination of solution mixing and mechanical dry mixing may be used to achieve a property in between that achieved by mechanical dry mixing or solution mixing alone. "Solution mixing," as used herein, refers to a method in which the matrix material may be dissolved in an appropriate solvent, the filler dispersed in the matrix solution, and then dried to form a matrix-filler composite film.

Exemplary embodiments of the present method in which the matrix and the filler are mechanically dry mixed include: 1) PMMA polymer as the matrix and carbon black as the filler; 2) PMMA polymer as the matrix and indium tin oxide (ITO) as the filler; 3) poly (acrylonitrile-co-butadiene-co-stryene) (ABS) as the matrix and carbon black as the filler; 4) polystyrene (PS) as the matrix and carbon black as the filler; and 5) PMMA as the matrix and red, green or blue phosphors as the filler(s). These embodiments will be described in greater detail in the examples below. Examples of the process for solution mixing include: 1) PMMA as the matrix, ethyl acetate as the solvent, and carbon black as the filler, and 2) ABS as the matrix, butane-2-one as the solvent, and carbon black as the filler. These will be described in greater detail in the examples below.

In embodiments where the combination of mechanical dry mixing and solution mixing is used, the matrix-filler composite film obtained by solution mixing is broken into smaller pieces and combined with a matrix-filler mixture obtained by mechanical dry mixing. The resulting combined matrix-filler mixture can then be molded according to the methods of the disclosure to form a composite. An exemplary embodiment of a method of making a composite of the present invention using a combination of mechanical dry mixing and solution mixing is described in greater detail in the examples below.

The matrix-filler mixture obtained according to the methods of the present disclosure, as described above, can then be compression molded by subjecting the mixture to a temperature and a pressure for an amount of time sufficient to achieve the microstructure described above with sufficient interconnectivity of the filler material to achieve the desired property.

In some embodiments, the matrix-filler mixture is compression molded at a temperature above the glass transition temperature of the matrix material. In some embodiments the temperature is above the glass transition temperature of the matrix material but below the melting point of the matrix material. In some exemplary embodiments the temperature is between about 40° C. and about 100° C. above the glass transition temperature, and is below the melting point of the matrix material. In some exemplary embodiments, the temperature is between about 140° and 190° C. In some embodiments, the mixture is heated at a first temperature for a first amount of time and then heated at a second temperature for a second amount of time. In some embodiments, the second temperature is higher than the first temperature. In an exemplary embodiment, the first temperature is between about 120° C. and about 160° C. and the second temperature is between about 140° C. and about 190° C.

In some embodiments of the disclosure the matrix-filler mixture is compression molded at a pressure between about 2 kN and about 24 kN. In preferred embodiments of the disclosure, the mixture is compression molded at a pressure between about 5 kN and about 20 kN. In some embodiments, the mixture is pressed at a first pressure for a first amount of time at a first temperature and then pressed at a second pressure for a second amount of time at a second temperature. Preferably, the second pressure is higher than the first pressure. In an exemplary embodiment, the first pressure is between about 2 kN and about 5 kN and the second pressure is between about 15 kN and about 20 kN.

In some embodiments of the disclosure the matrix-filler mixture is compression molded at a temperature and pressure for an amount of time between about 2 min and about 25 min. In some embodiments the mixture is molded at a first temperature and/or pressure for a first amount of time, and then molded at a second temperature and/or pressure for a second amount of time. In an exemplary embodiment, the first time is between about 2 min. and about 5 min. and the second time is between about 5 min. and about 15 min.

In an exemplary embodiment a PMMA/carbon black mixture was first compression molded at a first temperature of between about 140° C. and 160° C., at a pressure of about 2 kN, for about 2 minutes, and then compression molded at a second temperature between about 170° C. and about 190° C. at about 20 kN for about for 8 minutes. Other embodiments of processing conditions are presented in the examples below.

The combination of temperature, pressure and amount of time of compression molding of the mechanically mixed matrix and filler materials is selected such that the temperature is above the glass transition temperature of the matrix material, but below the melting temperature of the matrix material to allow for softening of the matrix material. The molding pressure and period of time for molding are selected to allow the matrix material to reform to fill the void spaces between the starting matrix material and form the afore-described pseudo-crystalline structure.

In some embodiments of this disclosure, the effect of the particle size ratio (ratio of matrix particle size to filler particle size) are also demonstrated. Size ratios as large as 10,000 and as small as 10 have been used. The closer the size of the two component sizes is, the higher the percolation threshold needed to achieve interconnectivity will be.

Methods of Controlling the Properties of the Composite Materials

A. Controlled Electrical Conductivity

The electrical conductivity of the composites of the present disclosure can be varied in magnitude by changing the volume fraction of the filler, varying the particle size of the filler, varying the initial matrix particle size, varying the ratio of the matrix particle size to the filler particle size, and/or changing the preparation method. FIGS. 5-7 and 9 demonstrate the effect of varying filler concentration while keeping the initial matrix particle size constant. In addition, FIG. 5 displays the effect of changing the filler particle size while keeping the matrix particle size constant. In contrast, FIG. 8 demonstrates the effect of varying the matrix particle size while keeping the filler particle size constant. The data in these figures is discussed in more detail in Examples 4 and 7 below.

Figure 6:
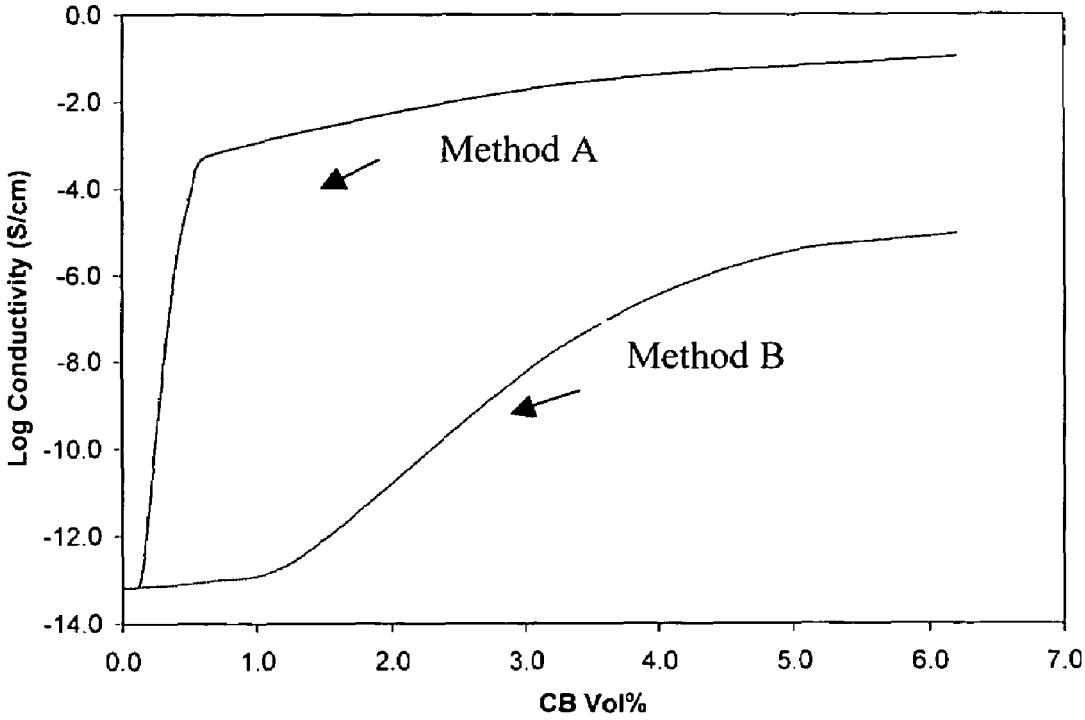
FIG. 6 is another conductivity graph illustrating the effect on achieving interconnectivity in a composite material by varying the mixing method. Method A involves only the dry mechanical method for mixing matrix and filler followed by compression molding the mixture of the present disclosure. Method B involves only a solution method for mixing matrix and filler followed by compression molding the mixture.
Figure 7:
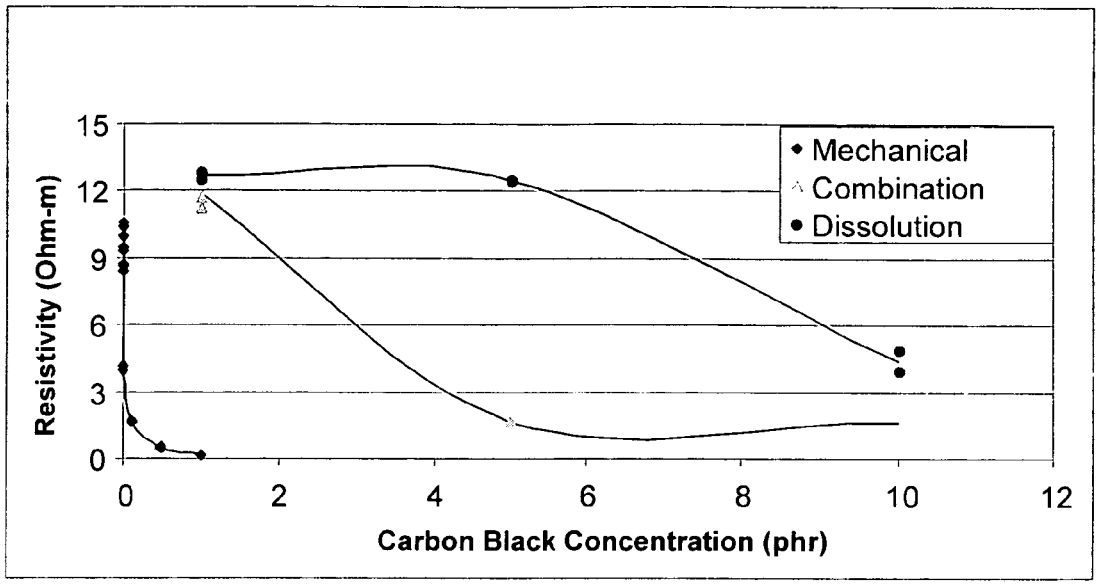
FIG. 7 depicts the resistivity of a composite made with the same filler and polymer precursor by varying the mixing method between mechanical dry mixing, solution mixing, and a combination thereof.

FIGS. 6 and 7 illustrate the effect of varying the fabrication method while using the same initial matrix particle size and filler particle size. Using a combination of the mechanical dry and solution methods for mixing the matrix and the filler, it is possible to achieve electrical conductivity anywhere in between that obtained for the two methods separately (shown in FIG. 7).

The effects of varying the mixing method are described in greater detail in the embodiments presented in Examples 5 and 6 below.

B. Particle Size Ratio

Figure 5:
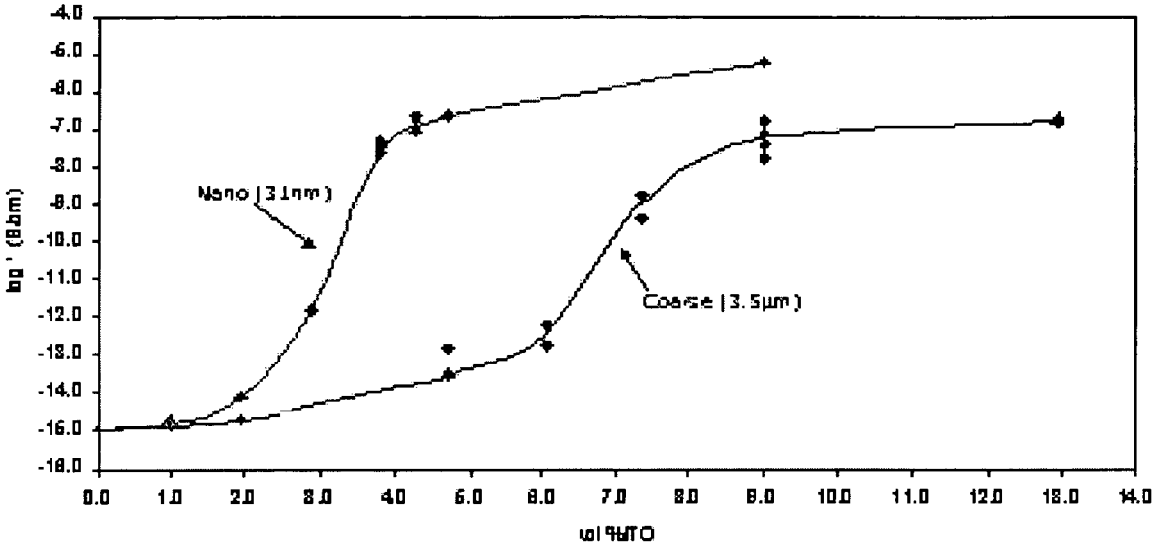
FIG. 5 is a graph illustrating the effect on conductivity of a composite of the present disclosure by varying the filler particle size while maintaining the same polymer matrix initial particle size.
Figure 8:
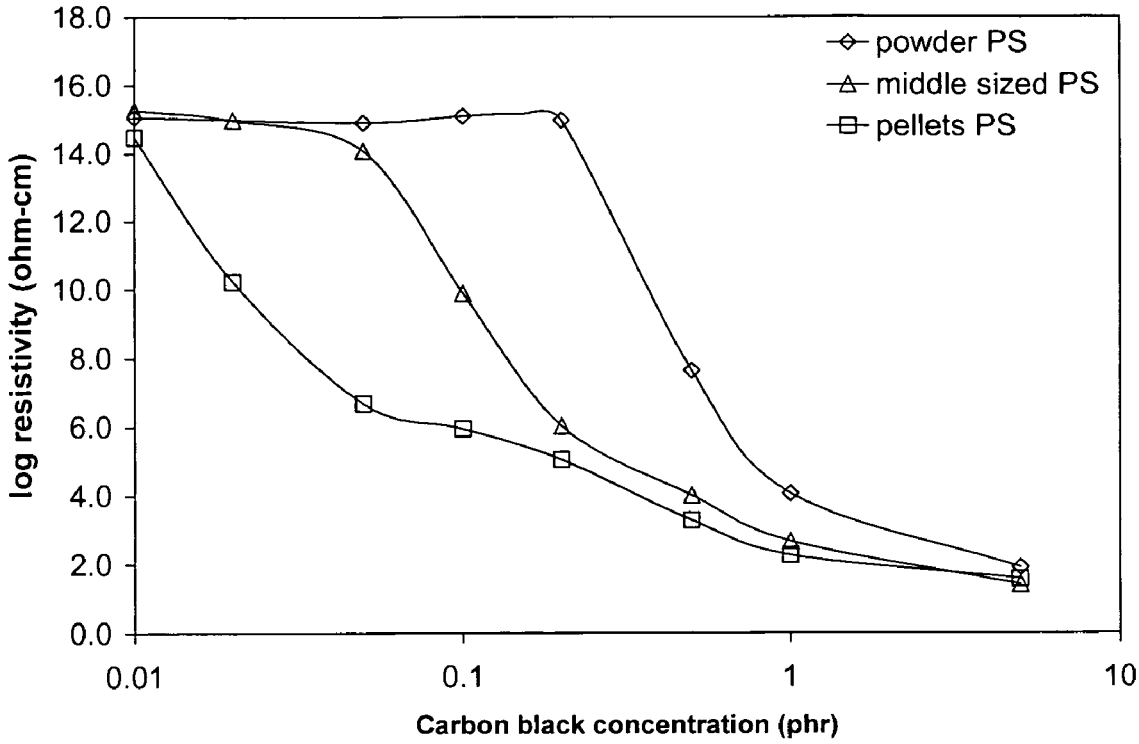
FIG. 8 is a resistivity graph illustrating the effect of varying the initial polymer matrix size while keeping the filler type, size and process method constant.

The present disclosure also provides the ability to make composites with controlled properties in a more reproducible fashion than the heretofore-accepted method of fabrication by dissolution of the matrix material alone. FIGS. 5 and 8 and Examples 4 and 7 below further demonstrate the effects of varying the ratio of the starting matrix particle size to that of the filler. FIG. 5 displays the conductivity of PMMA/ITO with the same starting matrix size but different filler size. FIG. 8 illustrates that the resistivity of polystyrene (PS)/CB composites of the present disclosure changes as a function of the PS matrix particle size while keeping the CB filler size constant.

C. Pressure Effect

Figure 9:
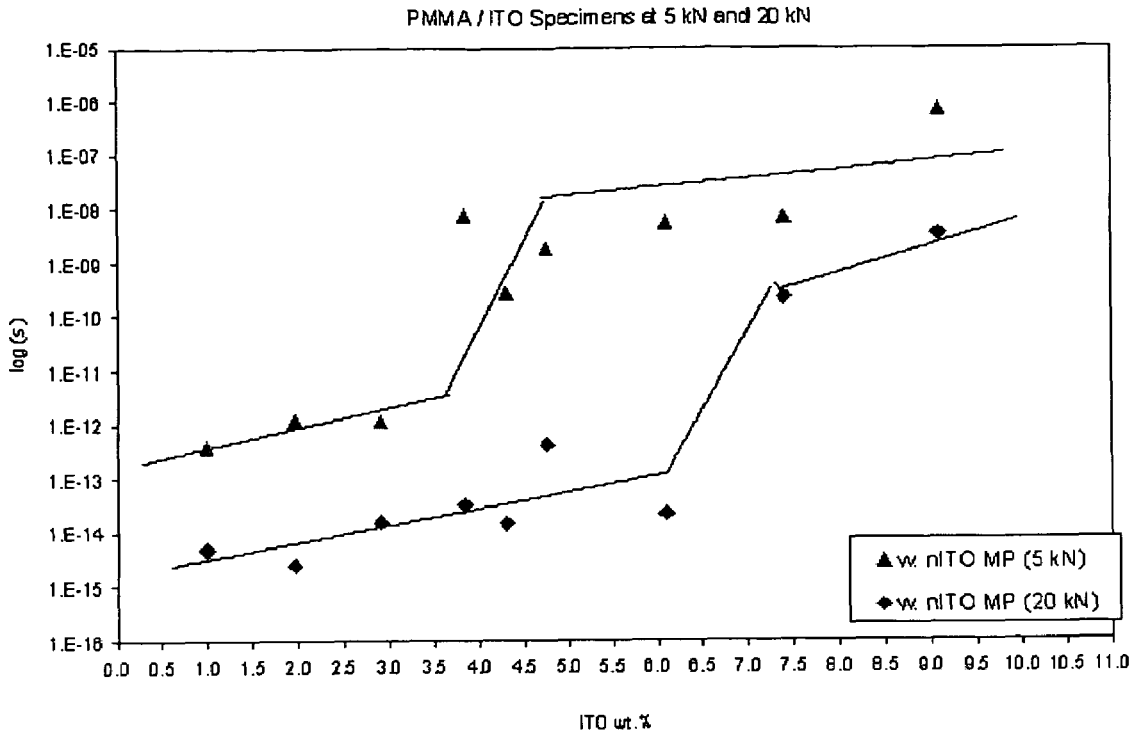
FIG. 9 is a graph illustrating the effect on conductivity of a composite of the present disclosure by varying the pressure used to form the composite.

The present disclosure also provides the ability to make composites with controlled properties by varying the molding pressure. FIG. 9 and Example 8 below provide further details. FIG. 9 illustrates the effect of changing the molding pressure from 5 kN to 20 kN while keeping the matrix and filler particle sizes constant for a PMMA/ITO composite as described in Example 8 below.

D. Controlled Luminescent Properties

Figure 10:
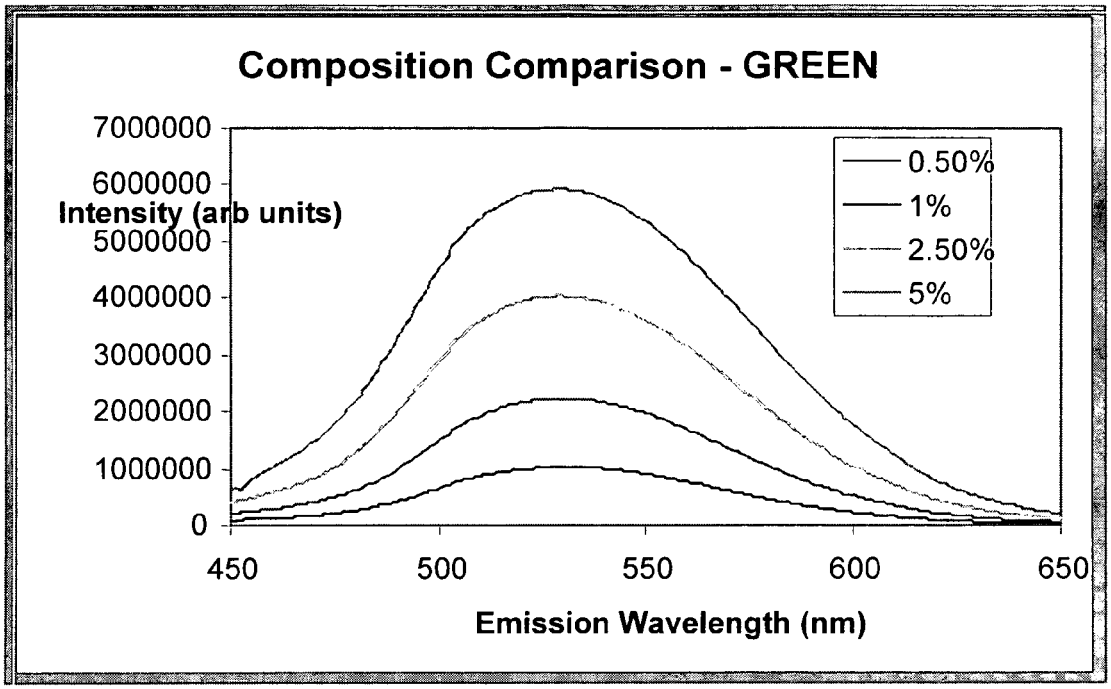
FIG. 10 is a graph illustrating luminescence intensity plotted versus emission wavelength for a composite material of the present disclosure containing various amounts of a green phosphor filler.

Luminescent composites can also be made according to the methods of the present disclosure. Exemplary composites were prepared with red, green and blue phosphors. FIG. 10 demonstrates the increase in the luminescence intensity as the amount of phosphor material is increased. Additional details regarding luminescent composites of the present disclosure are presented in Example 9 below.

E. Additional Properties

Addition of insulating fillers, magnetic fillers and ionic conducting fillers has been completed and they have been found to behave in a similar way as the above-described fillers. All of these polymer composites were fabricated and characterized according to the methods of the present disclosure.

It should be emphasized that the above-described embodiments of the present disclosure, particularly, any "preferred" embodiments, are merely possible examples of the implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure, and the present disclosure and protected by the following claims.

EXAMPLES

Embodiments of the present disclosure will employ, unless otherwise indicated, conventional techniques of polymer chemistry, electrochemistry, synthetic organic or inorganic chemistry, chemical and electrical engineering, and the like, which are within the skill of one in the art. Such techniques are explained fully in the literature.

The following examples are put forth so as to provide those of ordinary skill in the art with a complete disclosure and description of how to perform the methods and use the compositions disclosed and claimed herein. Efforts have been made to ensure accuracy with respect to numbers (e.g., amounts, temperature, etc.) but some errors and deviations should be accounted for. Unless indicated otherwise, parts are parts by weight, temperature is in ° C., and pressure is at or near atmospheric. Standard temperature and pressure are defined as 20° C. and 1 atmosphere.

Example 1

Preparation of PMMA/Carbon Black Composites

Buehler Transoptic PMMA powder (5-100 μm powders) and Columbian Chemicals N550 Carbon Black (43 nm average size, 121 DBPA) were used to make composites. Compositions ranging from pure PMMA to samples containing up to 15 phr ("phr"=parts per hundred of resin/polymer) Carbon Black were fabricated. After weighing the correct amounts of PMMA and Carbon Black, they were poured into a container and mixed using a blender. Mixing was accomplished in about five minutes. After mixing, the composite powders were pressed in a Struers mounting press using approximately 2 g of the mixture. The samples were pressed at 175 degrees Celsius for five minutes at 20 kN, after heating to temperature at 175° C. for 8 minutes and pre-pressing at 2 kN for 3 minutes.

After pressing, samples were removed from the press and the edges were shaved prior to measuring the thickness and diameter. Pellets were also weighed in order to compute their bulk density. Electrodes were obtained by painting the pellets using high purity silver conducting paint. Impedance measurements were carried out using a Solartron Impedance-Gain Phase Analyzer for frequencies ranging from 1 mHz to 1 MHz. Complex impedance plots were used to calculate the resistance of each sample and then converted to resistivity using the sample dimensions.

The data (not shown) indicates that as the phr of Carbon Black increased, the resistivity decreased. According to this data, percolation began almost immediately and the percolation threshold is located between the phr of 0.5 and 1.

Example 2

Preparation of PMMA/ITO Composites

PMMA/ITO composites were fabricated with Buehler© Transoptic Powder (PMMA) (5-100 μm powder) and Aldrich© ITO nanopowder (31 nm average size). Several composites were generated with varying concentrations of ITO nanopowder up to about 9 vol. % ITO. A blender was used to mix these materials for 5 mins. After mixing, PMMA/ITO composite pellets of ~2 g were formed by mount pressing at 2 kN for 3 mins (pre-heat) at 140° C. before further pressing at 20 kN for 5 mins at 170° C. After cooling for 7-10 mins to ambient temperature, the diameter, thickness, and mass of each pellet were determined. These were used to calculate the experimental bulk density of the composites.

Before impedance analysis, SEM high purity silver paint was applied to both sides of each pellet to act as a current collector. A Solartron© Impedance-Gain Phase Analyzer performed AC Impedance testing on the samples between frequencies of $1\times10^7$ and 0.01 Hz at 0.1 $V_{rms}$. For samples that were considerably insulating, Zview was utilized to extrapolate data results via equivalent circuit simulation to obtain final values of resistance. The data indicates that percolation occurs between 2% and 3% vol. ITO.

Example 3

Preparation of PMMA/CB Composites

Compositions ranging from pure PMMA to samples containing up to 6.5% CB were fabricated according to Example 1 and measured. Precursor materials were Buehler Transoptic PMMA powders of 5-100 μm particle size and Columbian Chemicals CDX-975 carbon black powders of average size 21 nm and 175 DBPA. Complex impedance plots were used to calculate the resistance of each sample and then converted to resistivity using the sample dimensions. Conductivities of the samples were obtained by fitting the experimental data with an equivalent circuit and normalizing by the sample dimensions.

The electrical impedance data (not shown) indicate that percolation begins almost immediately and that the threshold is at 0.133% CB by volume. See, Gabrielle G. Long, Lyle Levine and Rosario A. Gerhardt, "USAXS Imaging of PMMA-Carbon Black Composites," Advanced Photon Source Annual Report, February 2004, which is incorporated by reference as if fully set forth herein.

Example 4

Preparation of PMMA/ITO Composites Varying Filler Particle Size

PMMA/ITO composites were fabricated with Buehler© transoptic powder (PMMA) and Aldrich© ITO powders. At least three specimens of each composition were fabricated. After mixing as described in Example 2, PMMA/ITO composite pellets of ~2 g were formed by pressing the powder mix as described in Example 2. After cooling to ambient temperature, the diameter and thickness of each pellet were measured and then used to calculate the density. This preparation procedure was used for PMMA composites containing ITO nanopowders (having an average particle size of about 31 nm) and ITO micro-sized powder (having an average particle size of about 3.5 μm). The average particle size of the PMMA was about 5-100 μm. The filler concentrations were varied from 0-13 vol %.

Before impedance analysis, SEM high-purity silver paint was applied to both sides of each pellet to act as a current collector. A Solartron© Impedance-Gain Phase Analyzer was used to acquire the AC Impedance data between frequencies of $1\times10^7$ and 0.01 Hz at 0.1 $V_{rms}$.

Filler particles were not detected by the human eye at the surface of the composite, nor were there any significant clusters in the bulk, signifying the interface between the two phases was compatible. The specimens with lower concentrations of ITO were nearly translucent. The images presented in FIG. 3 are representative of the three dimensional microstructures of these specimens.

For samples that were considerably insulating, Zview was utilized to extrapolate data results via equivalent circuit simulation to complete the Cole-Cole plot and obtain the resistance values. The sample thickness and area of the electrodes were used for calculating the conductivity. The Zview software was used to simulate the equivalent circuit that represents the sample. A resistor (R), in parallel with a constant phase element (CPE), was used as the equivalent circuit.

The magnitude of the impedance vector was plotted versus the logarithm of the frequency for all of the nano-ITO-PMMA composite specimens measured. FIG. 5 illustrates conductivity as a function of ITO content for composites containing nano-ITO (31 nm) and micron-ITO (3.5 μm). The data show increased conductivity with increasing concentrations of ITO. FIG. 5 suggests that reducing the ITO particle size, and thereby increasing the ratio of PMMA particle size to ITO particle size, provokes a significantly earlier, sharper transition to percolation.

Notably, data depicted in this figure bears an S-shaped curve, which is consistent with the GEM equation. FIG. 5 indicates that the percolation threshold occurs at about 2-3% vol. for composites containing nano-ITO (31 nm starting particle size) and at about 6-8% vol. for composites containing micron-ITO (3.5 μm starting particle size). These are remarkable results, as a much higher volume fraction of ITO is traditionally required using conventional methods, such as the solution method or extrusion methods, to make composite materials. See, Charles J. Capozzi, Sandra J. Shackelford, Runqing Ou and Rosario A. Gerhardt, "Study of Percolation in PMMA-ITO Composites," MRS Proceedings 819, 303-308 (April 2004), which is incorporated herein by reference as if fully set forth herein.

Example 5

Preparation of PMMA/CB Composites Varying Mixing Method

The insulating polymer matrix PMMA was obtained from Buehler Ltd. (Transoptic powder). The powder particle size ranged from 5-100 μm. The conductive filler used was carbon black (CDX975) obtained from Columbian Chemicals. The particles have a mean diameter of 21 nm and a DBPA number of 175 ml 100 $gm^{-1}$.

Carbon Black was dispersed in the polymer through two methods. The first method of mixing was mechanical mixing at room temperature using a blender. The second method of mixing was dispersing carbon black in PMMA solution with the help of an ultrasonic bath and a magnetic stirrer. The PMMA solvent was ethyl acetate and the solid to solvent weight ratio was 1:6. The liquid dispersion was cast into a film and then the film was chopped into little pieces before being compression molded.

The composite mixtures were molded into pellets of 31.7 mm in diameter and approximately 1 mm in thickness as describe in Example 1 above. The pellet specimens were fractured and the fractured surfaces were gold coated before being examined in a Hitachi S-800 scanning electron microscope. The accelerating voltage used was 15 kV. For electrical property measurements, the specimen surfaces were painted with a conductive silver paint (SPI Supplies). Impedance measurements were performed using Solartron 1260 Impedance/Gain Phase analyzer with a 1296 Dielectric Interface. The frequency range measured was from $10^{-3}$ Hz to $10^7$ Hz.

The dc resistivity data were estimated by fitting the impedance data with equivalent circuits.

FIG. 6 shows conductivity as a function of filler concentration for the PMMA/carbon black composites made by the two different processing methods. The percolation threshold of the composite made by mechanical mixing followed by compression molding is about 0.3 Vol %. This is the lowest percolation threshold the authors are aware of for the PMMA/carbon black composite. On the other hand, solution mixing followed by compression molding results in a composite with a much higher (~2.7 Vol % CB) percolation threshold. It is believed that an important element to having an extremely low percolation threshold lies in the ability to create a segregated structure formed during the fabrication process. See, Runqing Ou, Sidhartha Gupta, Charles Aaron Parker and Rosario A. Gerhardt, "Low Percolation Threshold Composites Consisting of PMMA and Carbon Black," TMS Letters 2[4], 117-118 (2005), which is incorporated by reference as if fully set forth herein.

FIGS. 11A and B show SEM images of the fractured surfaces of the PMMA/CB composites made by the two methods described above: mechanical mixing (FIG. 11A) and solution mixing (FIG. 11B). The composite made by mechanical mixing followed by compression molding (similar to FIG. 4) looks like a collection of crystalline grains. Yet the PMMA-CB composite was revealed by X-ray diffraction to be noncrystalline, which is expected from a noncrystalline PMMA and a noncrystalline carbon black.

Without wishing to be bound by theory, it is believed that the pseudo-crystalline structure was formed when the originally spherical polymer particles were deformed into close-packed polyhedrons under heat and pressure. In the absence of shear, the conductive filler particles remain essentially located at the interfaces between the polymer particles, building up a continuous conductive network. In contrast, the pseudo-crystalline structure is absent in the composite made by solution mixing followed by compression molding (See FIG. 11B, which shows that it is featureless). In this case, the carbon black particles are more homogeneously dispersed within the PMMA, and thus a higher loading is necessary to reach percolation (as was suggested by FIG. 1B). Similar behavior has been observed for other polymers such as ABS and polystyrene.

Example 6

Preparation of ABS/CB Composites Varying Mixing Methods

The "Magnum" ABS resin used, supplied by the DOW Chemical Company, was in the form of small pellets of ~5 mm in diameter and a thickness of about 2 mm. The carbon black used was Raven 1000 BDS, supplied by Columbian Chemicals. The carbon black had an average particle size of 24 nm, a surface area of 92 $m^2/g$, and a DBPA of 55 ml/100 g. DBPA is the DiButyl Phthalate Absorption number which is indicative of the structure of carbon black, with higher numbers indicating carbon blacks which have a more branched structure.

A series of ABS/CB specimens were fabricated with CB concentrations ranging from 0 to 20 phr. Each composition was replicated 3-5 times. Phr is a unit used for the convenience of calculation. 1 phr means that for every 100 grams of ABS, 1 gram of carbon black is used. The composite specimens were fabricated in two ways. The first method of fabrication was the manual mixing method. In this method, the ABS pellets and carbon black powder were placed in a zip-lock bag and tossed and pressed manually for at least 10 minutes (done at room temperature and pressure) at 160° C. for 2 mins at 2 kN followed by compression molding for 8 mins at 20 kN pressure into a composite using a mounting press (Struers Prontopress). To test whether proper mixing had been achieved, at least three pellets were made of each mixture and each pellet was measured for electrical resistivity. A large standard deviation of resistivity values among different pellets would indicate poor mixing whereas tight values would indicate sufficient mixing. In the second method of fabrication, the dissolution method, the CB was dispersed in about 60 grams of Butan-2-one (methyl ethyl ketone) using a magnetic stirrer and an ultrasonic bath. The ABS resin was then dissolved in this CB suspension using the magnetic stirrer and the ultrasonic bath. The dispersion was then cast into a film, which was then cut up into fine pieces, and compression molded into the composites using a mounting press. The resulting composites had a diameter of 31.7 mm and a thickness ranging from 2 to 5 mm. In order to make comparisons between the two fabrication methods, the amount of carbon black used was adjusted depending on what portion of the percolation curve the conductivity measurements were needed to be made. For the manual mixing method, the carbon black level needed was 0 to 1 phr, whereas for the dissolution method, 0 to 20 phr was required.

For the electrical measurements, the surfaces of the composites were first painted with conductive silver paint and air dried. The impedance measurements were conducted using a Solartron 1260 Impedance Analyzer coupled with a 1296 Solartron Dielectric Interface. A two-probe test fixture was used. Impedance spectroscopy measurements were carried out at frequencies from $10^7$ Hz to $10^{-3}$ Hz at room temperature.

In FIG. 7, the log of the resistivity of different composite samples, fabricated using both the manual mixing method and the dissolution method, are plotted against the carbon black concentration. This figure also shows the resistivity curve for a specimen made using a combination of the two methods. This figure suggests that it is possible to vary the electrical properties of ABS/CB composites at the same content of CB over 12 orders of magnitude just by modifying the mixing parameters. Each data point shown represents the average of at least three specimens. In composites fabricated using the manual mixing method, it was seen that composites with carbon black concentration 0.005 phr or lower are very insulating in nature. However, a slightly higher concentration of 0.01 phr is much more conductive. The average resistivity of 0.01 phr is five orders of magnitude lower than that of the 0.0075 phr CB specimen and eight orders of magnitude lower than that of the 0.005 phr specimen. Beyond 0.01 phr, the resistivity continues to decrease, but in a more controlled manner, which allows us to infer that the percolation threshold is around 0.01 phr (0.0054 vol % CB) for the ABS/CB composites fabricated using the manual mixing method.

Similarly, for composites fabricated using the dissolution method, a drastic change was seen in the resistivities of the 2.5 and 5 phr CB concentration samples. The specimens containing higher concentrations of 10 phr show some more decrease in resistivities, but the change is not as drastic as the drop between 2.5 phr and 5 phr (seven orders of magnitude). Thus, we can say that the percolation threshold lies in the region of 5 phr (2.7 vol % CB) for the ABS/CB composites fabricated using the dissolution method. This threshold is substantially higher than the percolation threshold obtained for the composites fabricated using the manual mixing method. Similar resistivity results as a function of fabrication method have also been obtained for polymer matrix composites fabricated using polymethyl-methacrylate (PMMA) and carbon black. See, Sidhartha gupta, Runqing Ou and Rosario A. Gerhardt, "Effect of Fabrication Method on the Electrical Properties of ABS/CB Composites," Journal of Electronic Materials 35[2], in press (2006), which is incorporation by reference as if fully set forth herein.

The big difference in the percolation behavior caused by the two extreme fabrication methods (mechanical mixing and dissolution) can be explained by the different microstructures formed. FIG. 2 shows a picture of the original ABS pellets (FIG. 2A) and also the surface of a composite fabricated using the manual mixing method (FIG. 2B). It can be seen in FIG. 2B that although the ABS pellets do not retain their original shape (shown in FIG. 2A), they still retain their distinct identity. The carbon black was observed to be present in between the ABS grain boundaries (similar to FIG. 4A in this disclosure) On the other hand, the grain structure is absent in the specimens made by the dissolution method (FIG. 11B) because the original ABS pellets were all dissolved in the solution. Composites made by the dissolution method are completely black and do not show any surface markings as depicted in FIG. 11B.

Since percolation occurs when interconnectivity of the filler particles is achieved across the composite, it would be expected that the composites prepared using the manual mixing method would achieve percolation at lower filler concentrations than those made by the dissolution method. This is because the carbon black is highly localized around the ABS grain boundaries and surfaces. In contrast, higher loading of the CB filler is required for percolation to be achieved in composites fabricated by the dissolution method, since the CB network is more evenly distributed and more particles will be needed to span across the composite in the bulk as schematically depicted in FIG. 1A. It should be clear that fewer particles are needed to coat the surfaces of the ABS pellets (FIG. 1A) as compared to the many more needed to make an interconnected path throughout the bulk of the ABS amorphous matrix (FIG. 1B). As expected, the percolation threshold for composites fabricated using the manual mixing method ($\phi_c$=0.0054 vol % CB, 0.01 phr) is substantially lower than the percolation threshold for those composites prepared using the dissolution method ($\phi_c$=2.7 vol % CB, 5 phr in ref. 8 but about 10 phr in FIG. 7. The differences are related to some additional modifications made to the solution method and combination method. These values are considerably less than the percolation threshold obtained for ABS/CB composites reportedly fabricated using extrusion and a slightly different CB formulation. Finally, these results suggest that the combination method allow the fabrication of ABS/CB composites with electrical conductivity values comparable to those obtained with single wall carbon nanotubes in ABS. See, E. V. Barrera, J. Mater. 52 (38) (2000). By carefully controlling the fabrication method, one can control the microstructure and therefore determine the electrical properties achieved.

Example 7

Preparation of Polystyrene/CB Composites by Varying Polymer Matrix Particle Size Polystyrene(PS) pellets (initial particle size of approximately 3 mm in diameter) and Columbian Chemicals CDX-975 carbon black particle aggregates (21 nm average particle and 175 DBPA) were used to make composites by blending them via a manual mixing method. To vary the PS average size, the PS pellets were fractured and sieved. The three different PS sizes had averages of 3 mm, 1 mm and <0.5 mm. The blended mixtures of PS and CB were compression molded at 170° C. under 2 kN for 2 minutes and then pressed at 20 kN for 10 minutes before cooling for 5 minutes. FIG. 8 displays the electrical resistivity of this embodiment, which clearly indicates that decreasing the polymer matrix particle size, while keeping the filler size constant, results in a higher percolation threshold. It is to be noted that the ratio of initial polymer size to filler size has a much stronger effect on the percolation threshold than varying the filler particle size while keeping the polymer matrix size constant (as described in Example 4 and FIG. 5).

Example 8

Preparation of PMMA/ITO Composites by Varying Pressure

FIG. 9 displays the electrical conductivity of PMMA/ITO composites fabricated using the same conditions as in Example 1, using the same PMMA source and nano-ITO sources but varying the molding pressure while keeping the composition and mixing conditions the same. The specimens measured to obtain the data reported in FIG. 9 were compression molded at 170° C. for 15 min at 20 kN for one set of specimens and 15 min at 5 kN for the other set of specimens. It is clear that varying the molding pressure conditions can affect the concomitant percolation threshold achieved (and the resultant electrical conductivity, transparency and absorption of these materials). It is to be noted that one can obtain similar shifts in the percolation threshold if one varies the temperature and/or the time of molding for the same given composite composition.

Example 9

Preparation of PMMA/Phosphor Composites

Nanocomposites obtained by mixing of transparent poly (methyl)-methacrylate (PMMA) with various ratios of Eu-doped $Y_2O_2S$, (Cu, Al, Au)doped ZnS and Eu-doped $CaSrP_2O_7$ were fabricated and characterized. These phosphors emit light of color red, blue and green respectively. Powders of $Y_2O_2S$:Eu and ZnS:Cu, Al, Au were obtained from Osram Sylvania and $CaSrP_2O_7$:Eu was developed in house. [Richard Gilstrap M.S. Thesis]

Nanocomposite specimens were first fabricated between PMMA and each of the individual nanoparticle phosphors by mixing the individual powders and then compression molding the mixtures into solid pellets following the method described in Example 1. Phosphor concentrations were varied, for example from 0.5 to 5.0 phr. All specimens were optically transparent and highly dense (microstructures are similar to those displayed in the transparent composite optical transmission images displayed in FIG. 3). The presence of PMMA did not affect the PL emission spectra of any of the phosphors used to make the nanocomposites. In fact, transmission spectra of these specimens was independent of wavelength in the visible range, but did depend on phosphor concentration (data not shown). The photoluminescence properties of these specimens were measured between 350-650 nm. As expected, the specimens containing yttrium oxysulfide luminesce in the red region of the spectrum while the ZnS-containing specimens have maximum luminescence at 529 nm. Blue luminescence is obtained from Eu-doped $CaSrP_2O_7$ at a peak wavelength of 436 nm. The red phosphor nanocomposite gave a characteristic narrow spectrum at 625 nm and at other wavelengths below. The green phosphor had the widest emission spectra (shown in FIG. 10) which spanned from the blue to the red region while the blue phosphor specimen emission extended into the ultraviolet. The photoluminescence is seen to depend on the ratio of each of the phosphors used to the amount of polymer present in a non-linear way. Photoluminescent signals can be detected even when only 1 wt % of the phosphor was used, suggesting that this is an excellent way to obtain PL spectra when very small amounts of the phosphor material are available. At the same compositional phosphor content, the intensity of the light was in the order: red, green and then blue. Multiwavelength white light emission was also obtained by combining various ratios of these phosphor materials using the aforementioned mechanical mixing method followed by compression molding. This embodiment demonstrates the ability to obtain controlled luminescent and transparent properties of these materials.

It can be seen from the foregoing description that systems and methods are provided for forming composites, from matrix and filler materials, having lower percolation thresholds for the filler materials into the matrix materials and for controlling filler interconnectivity within the matrix material. Systems and methods are, thus, disclosed that provide the ability to control the desired properties of the composites.

While exemplary embodiments have been described for the present composite materials having low filler percolation thresholds and methods of controlling filler interconnectivity of such materials, it will be understood that those skilled in the art would recognize that one or more other matrix materials (polymer or otherwise) and/or filler materials may be used instead of those specifically described herein. It will also be apparent to those skilled in the art that the methods described above are not limited to the specific process conditions described.

It should be emphasized that the above-described embodiments of the present composites and methods, particularly, any "preferred" embodiments, are merely possible examples of implementations, merely set forth for a clear understanding of the principles of the invention. Many variations and modifications may be made to the above-described embodiment(s) without departing substantially from the spirit and principles of the invention. All such modifications and variations are intended to be included herein within the scope of this disclosure and protected by the following claims.

We claim:

1. A method of making a composite material including a matrix material and a filler material comprising the steps of:

(a) providing particles of a matrix material, the matrix material having a glass transition temperature;

(b) providing particles of a filler material, the matrix material having an average particle size and the filler material having an average particle size, the average particle size of the matrix material being at least about 10 times larger than the average particle size of the filler material;

(c) mechanically mixing the matrix material and filler material;

(d) heating the mixture to a temperature above the glass transition temperature and below the melting point of the matrix material; and (e) compression molding the mixture of matrix material and filler material at a temperature and at a pressure and for an amount of time sufficient to cause the matrix material to form a pseudo-crystalline structure with a polyhedral microstructure and to achieve a desired amount of interconnectivity of the filler material within said composite material.

2. The method of claim 1, wherein the filler material has a desired property, wherein the desired property is selected from: electrical conductivity, luminescence, electrical insulation, magnetic induction, transparency, optical transmission, or optical absorption, and wherein the composite material acquires the property of the filler material as a function of the amount of interconnectivity of the filler material.

3. The method of claim 1, wherein the amount of interconnectivity of the filler particles is controlled by varying one or more processing conditions selected from: the amount of filler material in the matrix-filler mixture; an average particle size of the filler particles; an average particle size of the matrix particles; the ratio of the average particle size of the matrix material to the average particle size of the filler material; a method of mixing of the matrix particles with the filler particles; the temperature at which the matrix-filler mixture is molded; the pressure at which the matrix -filler mixture is molded; or the time for which the matrix-filler mixture is molded.

4. The method of claim 1, wherein the time is between about 2 minutes and 25 minutes.

5. The method of claim 1, wherein the pressure is between about 2 kN and 24 kN.

6. A method of making a composite material including a matrix material and a filler material comprising the steps of:

(a) providing particles of a matrix material, the matrix material having a glass transition temperature;

(b) providing particles of a filler material, the matrix material having an average particle size and the filler material having an average particle size, the average particle size of the matrix material being at least about 10 times larger than the average particle size of the filler material;

(c) mechanically mixing the matrix material and filler material;

(d) heating the mixture to a temperature above the glass transition temperature and below the melting point of the matrix material; and (e) compression molding the mixture of matrix material and filler material at a temperature and at a pressure and for an amount of time sufficient to cause the matrix material to form a pseudo-crystalline structure with a polyhedral microstructure and to achieve a desired amount of interconnectivity of the filler material, wherein the amount of interconnectivity of the filler material can be controlled by varying one or more of the time, temperature and pressure of the molding, wherein the matrix-filler mixture is molded at a first temperature and pressure for a first amount of time and then molded at a second temperature and pressure for a second amount of time, wherein at least one of the first temperature, pressure and time are different from at least one of the second temperature, pressure and time.

7. The method of claim 6, wherein the second temperature and pressure are higher than the first temperature and pressure.

8. The method of claim 1, wherein the step of mechanically mixing is selected from: shaking, stirring, mixing in a blender, or mixing with a mortar and pestle.

9. The method of claim 1, wherein the step of mixing the matrix particles with the filler particles comprises a combination of mechanical dry mixing some of the matrix particles with some of the filler particles and solution mixing other of the matrix particles and other of the filler particles and combining product from the mechanical dry mixing and product from the solution mixing for the compression molding.

10. A method of making a composite material including a matrix material and a filler material comprising the steps of:

(a) providing particles of a matrix material, the matrix material having a glass transition temperature;

(b) providing particles of a filler material, the matrix material having an average particle size and the filler material having an average particle size, the average particle size of the matrix material being at least about 10 times larger than the average particle size of the filler material;

(c) mechanically mixing the matrix material and filler material;

(d) heating the mixture to a temperature above the glass transition temperature of the matrix material; and (e) compression molding the mixture of matrix material and filler material at a temperature and at a pressure and for an amount of time sufficient to cause the matrix material to form a pseudo-crystalline structure and to achieve a desired amount of interconnectivity of the filler material, wherein the amount of interconnectivity of the filler material can be controlled by varying one or more of the time, temperature and pressure of the molding, wherein the step of mixing the matrix particles with the filler particles comprises a combination of mechanical dry mixing and solution mixing, and wherein the solution mixing comprises the steps of:

(i) dissolving a portion of the matrix material in a solvent to produce a matrix solution;

(ii) dispersing a portion of the particles of filler material in the matrix solution to provide a matrix-filler solution;

(iii) drying the matrix-filler solution to form a matrix-filler composite film or powder; and (iv) mixing dried matrix-filler composite film or powder of step (iii) with mechanically mixed matrix material and filler material of step (c) to form the mixture of matrix material and filler material for compression molding in step (e).

11. A method of making a composite material including a matrix material and a filler material comprising the steps of:

(1) providing particles of a matrix material, the matrix material having a glass transition temperature;

(2) providing particles of a filler material, the matrix material having an average particle size and the filler material having an average particle size, the average particle size of the matrix material being at least about 10 times larger than the average particle size of the filler material;

(3) mechanically dry mixing and solution mixing the matrix material and the filler material and combining the results of both said mixings to form a combined mixture of matrix material and filler material;

(4) heating the combined mixture to a temperature above the glass transition temperature and below the melting point of the matrix material; and (5) compression molding the combined mixture of matrix material and filler material at a temperature and at a pressure and for an amount of time sufficient to cause the matrix material to form a pseudo-crystalline structure and to achieve a desired amount of interconnectivity of the filler material, wherein the amount of interconnectivity of the filler material can be controlled by varying one or more of the time, temperature and pressure of the molding;

wherein step (3) comprises the steps of:

(a) preparing a matrix-filler mixture by mechanically dry mixing a portion of the matrix particles with a portion of the filler particles;

(b) preparing a matrix-filler composite film by solution mixing a portion of the matrix particles with a portion of the filler particles;

(c) breaking the matrix-filler composite film into a plurality of matrix-filler composite film pieces; and (d) mixing the matrix-filler composite film pieces with the mechanically dry mixed matrix-filler mixture to form the combined mixture of matrix material and filler material.

12. The method of claim 11, wherein the solvent is selected from:

ethyl acetate or butane-2-one.

13. The method or claim 1, wherein the matrix material includes a material selected from a thermoplastic polymer material, a thermosetting material or a ceramimetallic glassy material, or combinations thereof.

14. The method of claim 1, wherein the matrix material includes a thermoplastic polymer selected from: poly(methyl methacrylate) (PMMA), poly(acrylonitrile-co-butadiene-co-styrene) (ABS), polystyrene (PS), polycarbonate (PC), or polyethylene oxide (PEO), or combinations thereof.

15. The method of claim 2, wherein the desired property is electrical conductivity, and the filler material includes a material selected from: carbon black (CB), indium tin oxide (ITO), Ag, Cu, or $LiClO_4$, or a conductive ceramic material, or combinations thereof.

16. The method of claim 2, wherein the desired property is luminescence and the filler material includes a material selected from red, green, or blue phosphors, or combinations thereof.

17. The method of claim 2, wherein the desired property is magnetic inductance, and the filler material includes a material selected from $Dy_2O_3$, or $Gd_2O_3$, or combinations thereof.

18. The method of claim 2, wherein the desired property is electrical insulation, and the filler material includes a material a dielectric material selected from $CeO_2$, $BaTiO_3$, or $Al_2O_3$, (PbZr) $TiO_3$, or combinations thereof.

19. The method of claim 6, wherein the matrix-filler mixture is pre-heated at said first temperature and pressure.

20. A method of making a composite material including a matrix material and a filler material comprising the steps of:

(a) providing particles of a matrix material, the matrix material having a glass transition temperature;

(b) providing particles of a filler material, the matrix material having an average particle size and the filler material having an average particle size, the average particle size of the matrix material being at least about 10 times larger than the average particle size of the filler material;

(c) mechanically mixing the matrix material and filler material;

(d) heating the mixture to a temperature above the glass transition temperature and below the melting point of the matrix material; and (e) compression molding the mixture of matrix material and filler material at a temperature and at a pressure and for an amount of time sufficient to cause the matrix material to form a pseudo-crystalline structure with a polyhedral microstructure and to achieve a desired amount of interconnectivity of the filler material within said composite material, wherein the matrix-filler mixture is pressed at a first pressure for a period of time and subsequently pressed at a second pressure, the second pressure being greater than the first pressure.

21. The method of claim 2, wherein the desired property is conductivity, and the filler material includes a conductive ceramic material.

22. The method of claim 1, wherein the filler material includes a material selected from a metal, an oxide ceramic, a dielectric material, a piezoelectric composition, a ferrite, a manganite, a carbide ceramic, a nitride ceramic, a hydroxide, a boride, a phosphide, a sulfide, a silicide, or a chalcogenide, or combinations thereof.

23. The method of claim 6, wherein the first temperature is between about 120° C. and about 160° C. and the second temperature is between about 140° C. and about 190° C.

24. A method of making a composite material including a matrix material and a filler material comprising the steps of:

(a) providing particles of a matrix material, the matrix material having a glass transition temperature;

(b) providing particles of a filler material, the matrix material having an average particle size and the filler material having an average particle size, the average particle size of the matrix material being at least about 10 times larger than the average particle size of the filler material;

(c) mechanically mixing the matrix material and filler material;

(d) heating the mixture to a temperature above the glass transition temperature of the matrix material; and (e) compression molding the mixture of matrix material and filler material at a temperature and at a pressure and for an amount of time sufficient to cause the matrix material to form a pseudo-crystalline structure with a polyhedral microstructure and to achieve a desired amount of interconnectivity of the filler material, wherein the amount of interconnectivity of the filler material can be controlled by varying one or more of the time, temperature and pressure of the molding, wherein the matrix-filler mixture is molded at a first temperature and pressure for a first amount of time and then molded at a second temperature and pressure for a second amount of time, wherein at least one of the first temperature, pressure and time are different from at least one of the second temperature, pressure and time.

25. The method of claim 24, wherein at least one of the second temperature, pressure and time is greater than at least one of the first temperature, pressure and time.

26. The method of claim 24, wherein the second pressure is greater than the first temperature.

27. The method of claim 24, wherein the second pressure and time are greater than the first pressure and time.

28. The method of claim 24, wherein the matrix material is poly(methyl methacrylate) (PMMA), the filler material is carbon black and the percolation threshold of the filler material into the pseudo-crystalline microstructure is about 0.3% filler or less.

* * * * *